US009076628B2

(12) United States Patent
Davis

(10) Patent No.: US 9,076,628 B2
(45) Date of Patent: Jul. 7, 2015

(54) VARIABLE RADIUS TAPER X-RAY WINDOW SUPPORT STRUCTURE

(71) Applicant: Brigham Young University, Provo, UT (US)

(72) Inventor: Robert C. Davis, Provo, UT (US)

(73) Assignee: Brigham Young University, Prove, UT (US)

( * ) Notice: Subject to any disclaimer, the term of this patent is extended or adjusted under 35 U.S.C. 154(b) by 342 days.

(21) Appl. No.: 13/670,710

(22) Filed: Nov. 7, 2012

(65) Prior Publication Data

US 2013/0064355 A1 Mar. 14, 2013

Related U.S. Application Data

(63) Continuation-in-part of application No. 13/667,273, filed on Nov. 2, 2012, which is a continuation-in-part of application No. 13/453,066, filed on Apr. 23, 2012.

(60) Provisional application No. 61/486,547, filed on May 16, 2011, provisional application No. 61/495,616, filed on Jun. 10, 2011, provisional application No. 61/511,793, filed on Jul. 26, 2011, provisional application No. 61/689,458, filed on Jun. 6, 2012.

(51) Int. Cl.
*H01J 35/18* (2006.01)

(52) U.S. Cl.
CPC ..... *H01J 35/18* (2013.01); *H01J 2235/18* (2013.01)

(58) Field of Classification Search
CPC ..... H01J 35/18; H01J 2235/18
USPC ..... 378/161
See application file for complete search history.

(56) References Cited

U.S. PATENT DOCUMENTS

| | | | |
|---|---|---|---|
| 1,276,706 | A | 5/1918 | Snook et al. |
| 1,881,448 | A | 10/1932 | Forde et al. |
| 1,946,288 | A | 2/1934 | Kearsley |
| 2,291,948 | A | 8/1942 | Cassen |
| 2,316,214 | A | 4/1943 | Atlee et al. |
| 2,329,318 | A | 9/1943 | Atlee et al. |
| 2,340,363 | A | 2/1944 | Atlee et al. |

(Continued)

FOREIGN PATENT DOCUMENTS

| | | |
|---|---|---|
| DE | 1030936 | 5/1958 |
| DE | 4430623 | 3/1996 |

(Continued)

OTHER PUBLICATIONS

PCT application EP12167551.6; filed May 10, 2012; Robert C. Davis; European search report mailed Nov. 21, 2013.

(Continued)

*Primary Examiner* — Allen C. Ho
(74) *Attorney, Agent, or Firm* — Thorpe North & Western, LLP

(57) ABSTRACT

A support structure for an x-ray window comprising a support frame defining a perimeter and an aperture, a plurality of ribs extending across the aperture of the support frame and carried by the support frame, and openings between the plurality of ribs. A rib taper region can extend from a central portion of the ribs to the support frame. The taper region can include a non-circular, arcuate pair of fillets on opposing sides of the ribs and an increasing of rib width from the central portion to the support frame.

20 Claims, 3 Drawing Sheets

(56) References Cited

U.S. PATENT DOCUMENTS

| | | | |
|---|---|---|---|
| 2,502,070 | A | 3/1950 | Atlee et al. |
| 2,663,812 | A | 3/1950 | Jamison et al. |
| 2,683,223 | A | 7/1954 | Hosemann |
| 2,952,790 | A | 9/1960 | Steen |
| 3,397,337 | A | 8/1968 | Denholm |
| 3,538,368 | A | 11/1970 | Oess |
| 3,665,236 | A | 5/1972 | Gaines et al. |
| 3,679,927 | A | 7/1972 | Kirkendall |
| 3,691,417 | A | 9/1972 | Gralenski |
| 3,741,797 | A | 6/1973 | Chavasse Jr. et al. |
| 3,751,701 | A | 8/1973 | Gralenski et al. |
| 3,801,847 | A | 4/1974 | Dietz |
| 3,828,190 | A | 8/1974 | Dahlin et al. |
| 3,882,339 | A | 5/1975 | Rate et al. |
| 3,962,583 | A | 6/1976 | Holland et al. |
| 3,970,884 | A | 7/1976 | Golden |
| 4,007,375 | A | 2/1977 | Albert |
| 4,075,526 | A | 2/1978 | Grubis |
| 4,160,311 | A | 7/1979 | Ronde et al. |
| 4,163,900 | A | 8/1979 | Warren et al. |
| 4,178,509 | A | 12/1979 | More et al. |
| 4,184,097 | A | 1/1980 | Auge |
| 4,250,127 | A | 2/1981 | Warren et al. |
| 4,368,538 | A | 1/1983 | McCorkle |
| 4,393,127 | A | 7/1983 | Greschner et al. |
| 4,463,257 | A | 7/1984 | Simpkins et al. |
| 4,463,338 | A | 7/1984 | Utner et al. |
| 4,521,902 | A | 6/1985 | Peugeot |
| 4,532,150 | A | 7/1985 | Endo et al. |
| 4,573,186 | A | 2/1986 | Reinhold |
| 4,576,679 | A | 3/1986 | White |
| 4,584,056 | A | 4/1986 | Perret et al. |
| 4,591,756 | A | 5/1986 | Avnery |
| 4,608,326 | A | 8/1986 | Neukermans et al. |
| 4,645,977 | A | 2/1987 | Kurokawa et al. |
| 4,675,525 | A | 6/1987 | Amingual et al. |
| 4,679,219 | A | 7/1987 | Ozaki |
| 4,688,241 | A | 8/1987 | Peugeot |
| 4,696,994 | A | 9/1987 | Nakajima et al. |
| 4,705,540 | A | 11/1987 | Hayes |
| 4,777,642 | A | 10/1988 | Ono |
| 4,797,907 | A | 1/1989 | Anderton |
| 4,818,806 | A | 4/1989 | Kunimune et al. |
| 4,819,260 | A | 4/1989 | Haberrecker |
| 4,862,490 | A | 8/1989 | Karnezos et al. |
| 4,870,671 | A | 9/1989 | Hershyn |
| 4,876,330 | A | 10/1989 | Higashi et al. |
| 4,878,866 | A | 11/1989 | Mori et al. |
| 4,885,055 | A | 12/1989 | Woodbury et al. |
| 4,891,831 | A | 1/1990 | Tanaka et al. |
| 4,933,557 | A | 6/1990 | Perkins et al. |
| 4,939,763 | A | 7/1990 | Pinneo et al. |
| 4,957,773 | A | 9/1990 | Spencer et al. |
| 4,960,486 | A | 10/1990 | Perkins et al. |
| 4,969,173 | A | 11/1990 | Valkonet |
| 4,979,198 | A | 12/1990 | Malcolm et al. |
| 4,979,199 | A | 12/1990 | Cueman et al. |
| 5,010,562 | A | 4/1991 | Hernandez et al. |
| 5,063,324 | A | 11/1991 | Grunwald et al. |
| 5,066,300 | A | 11/1991 | Isaacson et al. |
| 5,077,771 | A | 12/1991 | Skillicorn et al. |
| 5,077,777 | A | 12/1991 | Daly |
| 5,090,046 | A | 2/1992 | Friel |
| 5,105,456 | A | 4/1992 | Rand et al. |
| 5,117,829 | A | 6/1992 | Miller et al. |
| 5,153,900 | A | 10/1992 | Nomikos et al. |
| 5,161,179 | A | 11/1992 | Suzuki et al. |
| 5,173,612 | A | 12/1992 | Imai et al. |
| 5,196,283 | A | 3/1993 | Ikeda et al. |
| 5,217,817 | A | 6/1993 | Verspui et al. |
| 5,226,067 | A | 7/1993 | Allred et al. |
| RE34,421 | E | 10/1993 | Parker et al. |
| 5,258,091 | A | 11/1993 | Imai et al. |
| 5,267,294 | A | 11/1993 | Kuroda et al. |
| 5,343,112 | A | 8/1994 | Wegmann |
| 5,391,958 | A | 2/1995 | Kelly |
| 5,400,385 | A | 3/1995 | Blake et al. |
| 5,422,926 | A | 6/1995 | Smith et al. |
| 5,428,658 | A | 6/1995 | Oettinger et al. |
| 5,432,003 | A | 7/1995 | Plano et al. |
| 5,465,023 | A | 11/1995 | Garner |
| 5,469,429 | A | 11/1995 | Yamazaki et al. |
| 5,469,490 | A | 11/1995 | Golden et al. |
| 5,478,266 | A | 12/1995 | Kelly |
| 5,524,133 | A | 6/1996 | Neale et al. |
| 5,561,342 | A | 10/1996 | Roeder et al. |
| 5,567,929 | A | 10/1996 | Ouimette |
| RE35,383 | E | 11/1996 | Miller et al. |
| 5,571,616 | A | 11/1996 | Phillips et al. |
| 5,578,360 | A | 11/1996 | Viitanen |
| 5,607,723 | A | 3/1997 | Plano et al. |
| 5,621,780 | A | 4/1997 | Smith et al. |
| 5,627,871 | A | 5/1997 | Wang |
| 5,631,943 | A | 5/1997 | Miles |
| 5,680,433 | A | 10/1997 | Jensen |
| 5,682,412 | A | 10/1997 | Skillicorn et al. |
| 5,696,808 | A | 12/1997 | Lenz |
| 5,729,583 | A | 3/1998 | Tang et al. |
| 5,740,228 | A | 4/1998 | Schmidt et al. |
| 5,774,522 | A | 6/1998 | Warburton |
| 5,812,632 | A | 9/1998 | Schardt et al. |
| 5,835,561 | A | 11/1998 | Moorman et al. |
| 5,870,051 | A | 2/1999 | Warburton |
| 5,898,754 | A | 4/1999 | Gorzen |
| 5,907,595 | A | 5/1999 | Sommerer |
| 6,002,202 | A | 12/1999 | Meyer et al. |
| 6,005,918 | A | 12/1999 | Harris et al. |
| 6,044,130 | A | 3/2000 | Inazura et al. |
| 6,062,931 | A | 5/2000 | Chuang et al. |
| 6,069,278 | A | 5/2000 | Chuang |
| 6,075,839 | A | 6/2000 | Treseder |
| 6,097,790 | A | 8/2000 | Hasegawa et al. |
| 6,133,401 | A | 10/2000 | Jensen |
| 6,134,300 | A | 10/2000 | Trebes et al. |
| 6,184,333 | B1 | 2/2001 | Gray |
| 6,205,200 | B1 | 3/2001 | Boyer et al. |
| 6,282,263 | B1 | 8/2001 | Arndt et al. |
| 6,288,209 | B1 | 9/2001 | Jensen |
| 6,307,008 | B1 | 10/2001 | Lee et al. |
| 6,320,019 | B1 | 11/2001 | Lee et al. |
| 6,351,520 | B1 | 2/2002 | Inazaru |
| 6,385,294 | B2 | 5/2002 | Suzuki et al. |
| 6,438,207 | B1 | 8/2002 | Chidester et al. |
| 6,477,235 | B2 | 11/2002 | Chornenky et al. |
| 6,487,272 | B1 | 11/2002 | Kutsuzawa |
| 6,487,273 | B1 | 11/2002 | Takenaka et al. |
| 6,494,618 | B1 | 12/2002 | Moulton |
| 6,546,077 | B2 | 4/2003 | Chornenky et al. |
| 6,567,500 | B2 | 5/2003 | Rother |
| 6,646,366 | B2 | 11/2003 | Hell et al. |
| 6,658,085 | B2 | 12/2003 | Sklebitz |
| 6,661,876 | B2 | 12/2003 | Turner et al. |
| 6,740,874 | B2 | 5/2004 | Doring |
| 6,778,633 | B1 | 8/2004 | Loxley et al. |
| 6,799,075 | B1 | 9/2004 | Chornenky et al. |
| 6,803,570 | B1 | 10/2004 | Bryson, III et al. |
| 6,803,571 | B1 | 10/2004 | Mankos et al. |
| 6,816,573 | B2 | 11/2004 | Hirano et al. |
| 6,819,741 | B2 | 11/2004 | Chidester |
| 6,838,297 | B2 | 1/2005 | Iwasaki |
| 6,852,365 | B2 | 2/2005 | Smart et al. |
| 6,876,724 | B2 | 4/2005 | Zhou et al. |
| 6,956,706 | B2 | 10/2005 | Brandon |
| 6,962,782 | B1 | 11/2005 | Livache et al. |
| 6,976,953 | B1 | 12/2005 | Pelc |
| 6,987,835 | B2 | 1/2006 | Lovoi |
| 7,035,379 | B2 | 4/2006 | Turner et al. |
| 7,046,767 | B2 | 5/2006 | Okada et al. |
| 7,085,354 | B2 | 8/2006 | Kanagami |
| 7,130,380 | B2 | 10/2006 | Lovoi et al. |
| 7,130,381 | B2 | 10/2006 | Lovoi et al. |
| 7,203,283 | B1 | 4/2007 | Puusaari |
| 7,206,381 | B2 | 4/2007 | Shimono et al. |
| 7,215,741 | B2 | 5/2007 | Ukita |

(56) References Cited

U.S. PATENT DOCUMENTS

| | | | | |
|---|---|---|---|---|
| 7,224,769 | B2 | 5/2007 | Turner | |
| 7,233,647 | B2 | 6/2007 | Turner et al. | |
| 7,286,642 | B2 | 10/2007 | Ishikawa et al. | |
| 7,305,066 | B2 | 12/2007 | Ukita | |
| 7,358,593 | B2 | 4/2008 | Smith et al. | |
| 7,382,862 | B2 | 6/2008 | Bard et al. | |
| 7,428,298 | B2 | 9/2008 | Bard et al. | |
| 7,448,801 | B2 | 11/2008 | Oettinger et al. | |
| 7,448,802 | B2 | 11/2008 | Oettinger et al. | |
| 7,486,774 | B2 | 2/2009 | Cain | |
| 7,526,068 | B2 | 4/2009 | Dinsmore | |
| 7,529,345 | B2 | 5/2009 | Bard et al. | |
| 7,618,906 | B2 | 11/2009 | Meilahti | |
| 7,634,052 | B2 | 12/2009 | Grodzins | |
| 7,649,980 | B2 | 1/2010 | Aoki et al. | |
| 7,657,002 | B2 | 2/2010 | Burke et al. | |
| 7,684,545 | B2 | 3/2010 | Damento et al. | |
| 7,693,265 | B2 | 4/2010 | Hauttmann et al. | |
| 7,709,820 | B2 | 5/2010 | Decker et al. | |
| 7,737,424 | B2 | 6/2010 | Xu et al. | |
| 7,756,251 | B2 | 7/2010 | Davis et al. | |
| 7,983,394 | B2 | 7/2011 | Kozaczek | |
| 8,498,381 | B2 | 7/2013 | Liddiard | |
| 8,929,515 | B2 * | 1/2015 | Liddiard | 378/140 |
| 8,989,354 | B2 * | 3/2015 | Davis et al. | 378/161 |
| 2002/0075999 | A1 | 6/2002 | Rother | |
| 2002/0094064 | A1 | 7/2002 | Zhou et al. | |
| 2003/0096104 | A1 | 5/2003 | Tobita et al. | |
| 2003/0117770 | A1 | 6/2003 | Montgomery et al. | |
| 2003/0152700 | A1 | 8/2003 | Asmussen et al. | |
| 2004/0076260 | A1 | 4/2004 | Charles, Jr. et al. | |
| 2004/0131835 | A1 | 7/2004 | Schmitt et al. | |
| 2005/0018817 | A1 | 1/2005 | Oettinger et al. | |
| 2005/0141669 | A1 | 6/2005 | Shimono et al. | |
| 2005/0207537 | A1 | 9/2005 | Ukita | |
| 2006/0098778 | A1 | 5/2006 | Oettinger et al. | |
| 2006/0233307 | A1 | 10/2006 | Dinsmore | |
| 2006/0269048 | A1 | 11/2006 | Cain | |
| 2007/0025516 | A1 | 2/2007 | Bard et al. | |
| 2007/0111617 | A1 | 5/2007 | Meilahti | |
| 2007/0133921 | A1 | 6/2007 | Haffner et al. | |
| 2007/0165780 | A1 | 7/2007 | Durst et al. | |
| 2007/0183576 | A1 | 8/2007 | Burke et al. | |
| 2008/0296479 | A1 | 12/2008 | Anderson et al. | |
| 2008/0296518 | A1 | 12/2008 | Xu et al. | |
| 2008/0317982 | A1 | 12/2008 | Hecht | |
| 2009/0086923 | A1 | 4/2009 | Davis et al. | |
| 2010/0096595 | A1 | 4/2010 | Prud'Homme et al. | |
| 2010/0126660 | A1 | 5/2010 | O'Hara | |
| 2010/0140497 | A1 | 6/2010 | Damiano, Jr. et al. | |
| 2010/0239828 | A1 | 9/2010 | Cornaby et al. | |
| 2010/0243895 | A1 | 9/2010 | Xu et al. | |
| 2010/0248343 | A1 | 9/2010 | Aten et al. | |
| 2010/0285271 | A1 | 11/2010 | Davis et al. | |
| 2010/0323419 | A1 | 12/2010 | Aten et al. | |
| 2011/0017921 | A1 | 1/2011 | Jiang et al. | |
| 2011/0089330 | A1 | 4/2011 | Thomas | |
| 2011/0121179 | A1 | 5/2011 | Liddiard | |
| 2012/0025110 | A1 | 2/2012 | Davis | |
| 2012/0087476 | A1 | 4/2012 | Liddiard | |
| 2012/0213336 | A1 | 8/2012 | Liddiard | |
| 2013/0051535 | A1 | 2/2013 | Davis | |
| 2013/0064355 | A1 | 3/2013 | Davis | |
| 2013/0077761 | A1 * | 3/2013 | Sipila | 378/161 |
| 2013/0089184 | A1 * | 4/2013 | Sipila | 378/161 |
| 2013/0094629 | A1 | 4/2013 | Liddiard | |
| 2013/0315380 | A1 * | 11/2013 | Davis et al. | 378/161 |
| 2015/0016593 | A1 * | 1/2015 | Larson et al. | 378/161 |

FOREIGN PATENT DOCUMENTS

| | | |
|---|---|---|
| DE | 19818057 | 11/1999 |
| EP | 0297808 | 1/1989 |
| EP | 0330456 | 8/1989 |
| EP | 0400655 | 5/1990 |
| EP | 0676772 | 3/1995 |
| GB | 1252290 | 11/1971 |
| JP | 57082954 | 8/1982 |
| JP | S6074253 | 4/1985 |
| JP | S6089054 | 5/1985 |
| JP | 3170673 | 7/1991 |
| JP | 05066300 | 3/1993 |
| JP | 5135722 | 6/1993 |
| JP | 06119893 | 7/1994 |
| JP | 6289145 | 10/1994 |
| JP | 6343478 | 12/1994 |
| JP | 8315783 | 11/1996 |
| JP | 2001179844 | 7/2001 |
| JP | 2003/007237 | 1/2003 |
| JP | 2003/088383 | 3/2003 |
| JP | 2003510236 | 3/2003 |
| JP | 2003/3211396 | 7/2003 |
| JP | 4171700 | 6/2006 |
| JP | 2006297549 | 11/2006 |
| KR | 10-2005-0107094 | 11/2005 |
| WO | WO 99/65821 | 12/1999 |
| WO | WO 00/09443 | 2/2000 |
| WO | WO 00/17102 | 3/2000 |
| WO | WO 03/076951 | 9/2003 |
| WO | WO 2008/052002 | 5/2008 |
| WO | WO 2009/009610 | 1/2009 |
| WO | WO 2009/045915 | 4/2009 |
| WO | WO 2009/085351 | 7/2009 |
| WO | WO 2010/107600 | 9/2010 |

OTHER PUBLICATIONS

U.S. Appl. No. 12/899,750; filed Oct. 7, 2010; Steven Liddiard; Notice of Allowance dated Jun. 4, 2013.

U.S. Appl. No. 13/855,575; filed Apr. 2, 2013; Robert C. Davis.

Anderson et al., U.S. Appl. No. 11/756,962, filed Jun. 1, 2007.

Barkan et al., "Improved window for low-energy x-ray transmission a Hybrid design for energy-dispersive microanalysis," Sep. 1995, 2 pages, Ectroscopy 10(7).

Blanquart et al.; "XPAD, a New Read-out Pixel Chip for X-ray Counting"; IEEE Xplore; Mar. 25, 2009.

Comfort, J. H., "Plasma-enhanced chemical vapor deposition of in situ doped epitaxial silicon at low temperatures," J. Appl. Phys. 65, 1067 (1989).

Das, D. K., and K. Kumar, "Chemical vapor deposition of boron on a beryllium surface," Thin Solid Films, 83(1), 53-60, Sep. 4, 1981.

Das, K., and Kumar, K., "Tribological behavior of improved chemically vapor-deposited boron on beryllium," Thin Solid Films, 108(2), 181-188, Oct. 14, 1983.

Grybos et al.; "DEDIX—Development of Fully Integrated Multichannel ASIC for High Count Rate Digital X-ray Imagining systems"; IEEE 2006; Nuclear Science Symposium Conference Record.

Grybos, "Pole-Zero Cancellations Circuit With Pulse Pile-Up Tracking System for Low Noise Charge-Sensitive Amplifiers"; Mar. 25, 2009; from IEEE Xplore.

Grybos, et al "Measurements of Matching and High Count Rate Performance of Multichannel ASIC for Digital X-Ray Imaging Systems"; IEEE Transactions on Nuclear Science, vol. 54, No. 4, 2007.

Hanigofsky, J. A., K. L. More, and W. J. Lackey, "Composition and microstructure of chemically vapor-deposited boron nitride, aluminum nitride, and boron nitride + aluminum nitride composites," J. Amer. Ceramic Soc. 74, 301 (1991).

Hexcel Corporation; "Prepreg Technology" brochure; Mar. 2005 http://www.hexcel.com/Reso2882urces/DataSheets/Brochure-Data-Sheets/Prepreg_Technology.pdf.

http://www.orau.org/ptp/collection/xraytubescollidge/MachelettCW250.htm, 1999, 2 pgs.

Komatsu, S., and Y. Moriyoshi, "Influence of atomic hydrogen on the growth reactions of amorphous boron films in a low-pressure B.sub.2 H.sub.6 +He+H.sub.2 plasma", J. Appl. Phys. 64, 1878 (1988).

Komatsu, S., and Y. Moriyoshi, "Transition from amorphous to crystal growth of boron films in plasma-enhanced chemical vapor deposition with B.sub.2 H.sub.6 +He," J. Appl. Phys., 66, 466 (1989).

(56) References Cited

OTHER PUBLICATIONS

Komatsu, S., and Y. Moriyoshi, "Transition from thermal-to electron-impact decomposition of diborane in plasma-enhanced chemical vapor deposition of boron films from B.sub.2 H.sub.6 +He," J. Appl. Phys. 66, 1180 (1989).
Lee, W., W. J. Lackey, and P. K. Agrawal, "Kinetic analysis of chemical vapor deposition of boron nitride," J. Amer. Ceramic Soc. 74, 2642 (1991).
Lines, U.S. Appl. No. 12/352,864, filed Jan. 13, 2009.
Lines, U.S. Appl. No. 12/726,120, filed Mar. 17, 2010.
Maya, L., and L. A. Harris, "Pyrolytic deposition of carbon films containing nitrogen and/or boron," J. Amer. Ceramic Soc. 73, 1912 (1990).
Michaelidis, M., and R. Pollard, "Analysis of chemical vapor deposition of boron," J. Electrochem. Soc. 132, 1757 (1985).
Micro X-ray Tube Operation Manual, X-ray and Specialty Instruments Inc., 1996, 5 pages.
Moore, A. W., S. L. Strong, and G. L. Doll, "Properties and characterization of codeposited boron nitride and carbon materials," J. Appl. Phys. 65, 5109 (1989).
Nakajima et al; Trial Use of Carbon-Fiber-Reinforced Plastic as a Non-Bragg Window Material of X-Ray Transmission; Rev. Sci. Instrum.; Jul. 1989; pp. 2432-2435; vol. 60, No. 7.
Nakamura, K., "Preparation and properties of amorphous boron nitride films by molecular flow chemical vapor deposition," J. Electrochem. Soc. 132, 1757 (1985).
Neyco, "SEM & TEM: Grids"; catalog; http://www.neyco.fr/pdf/Grids.pdf#page=1 , Sep. 2009.
Panayiotatos, et al., "Mechanical performance and growth characteristics of boron nitride films with respect to their optical, compositional properties and density," Surface and Coatings Technology, 151-152 (2002) 155-159.
Perkins, F. K., R. A. Rosenberg, and L. Sunwoo, "Synchrotronradiation deposition of boron and boron carbide films from boranes and carboranes: decaborane," J. Appl. Phys. 69,4103 (1991).
Powell et al., "Metalized polyimide filters for x-ray astronomy and other applications," SPIE, pp. 432-440, vol. 3113.
Rankov. A. "A Novel Correlated Double Sampling Poly-Si Circuit for Readout System in Large Area X-Ray Sensors", 2005.
Roca i Cabarrocas, P., S. Kumar, and B. Drevillon, "In situ study of the thermal decomposition of B.sub.2 H.sub.6 by combining spectroscopic ellipsometry and Kelvin probe measurements," J. Appl. Phys. 66, 3286 (1989).
Scholze et al., "Detection efficiency of energy-dispersive detectors with low-energy windows" X-Ray Spectrometry, X-Ray Spectrom, 2005: 34: 473-476.
Sheather, "The support of thin windows for x-ray proportional counters," Journal Phys,E., Apr. 1973, pp. 319-322, vol. 6, No. 4.
Shirai, K., S.-I. Gonda, and S. Gonda, "Characterization of hydrogenated amorphous boron films prepared by electron cyclotron resonance plasma chemical vapor deposition method," J. Appl. Phys. 67, 6286 (1990).
Tamura, et al "Developmenmt of ASICs for CdTe Pixel and Line Sensors", IEEE Transactions on Nuclear Science, vol. 52, No., 5, Oct. 2005.
Tien-Hui Lin et al., "An investigation on the films used as teh windows of ultra-soft X-ray counters." Acta Physica Sinica, vol. 27, No. 3, pp. 276-83, May 1978, abstract only.
Vandenbulcke, L. G., "Theoretical and experimental studies on the chemical vapor deposition of boron carbide," Indust. Eng. Chem. Prod. Res. Dev. 24, 568 (1985).
Viitanen Veli-Pekka et al., Comparison of Ultrathin X-Ray Window Designs, presented at the Soft X-rays in the 21st Century Conference held in Provo, Utah Feb. 10-13, 1993, pp. 182-190.
Wagner et al, "Effects of Scatter in Dual-Energy Imaging: An Alternative Analysis"; IEEE; Sep. 1989, vol. 8. No. 3.
Winter, J., H. G. Esser, and H. Reimer, "Diborane-free boronization," Fusion Technol. 20, 225 (1991).
Wu, et al.; "Mechanical properties and thermo-gravimetric analysis of PBO thin films"; Advanced Materials Laboratory, Institute of Electro-Optical Engineering; Apr. 30, 2006.
www.moxtek.com, Moxtek, AP3 Windows, Ultra-thin Polymer X-Ray Windows, 2 pages, Sep. 2006.
www.moxtek.com, Moxtek, DuraBeryllium X-Ray Windows, 2 pages, May 2007.
www.moxtek.com, Moxtek, ProLine Series 10 Windows, Ultra-thin Polymer X-Ray Windows, 2 pages, Sep. 2006.
www.moxtek.com, Moxtek, Sealed Proportional Counter X-Ray Windows, 3 pages, Oct. 2007.
www.moxtek.com, X-Ray Windows, ProLINE Series 20 Windows Ultra-thin Polymer X-ray Windows, 2 pages, Sep. 2006.
Yan, Xing-Bin, et al., Fabrications of Three-Dimensional ZnO-Carbon Nanotube (CNT) Hybrids Using Self-Assembled CNT Micropatterns as Framework, 2007. pp. 17254-17259, vol. III.
U.S. Appl. No. 12/640,154; filed Dec. 17, 2009; Krzysztof Kozaczek.
U.S. Appl. No. 12/783,707; filed May 20, 2010; Steven D. Liddiard.
U.S. Appl. No. 12/899,750; filed Oct. 7, 2010; Steven Liddiard.
U.S. Appl. No. 13/018,667; filed Feb. 1, 2011; Lei Pei.
U.S. Appl. No. 13/307,579; filed Nov. 30, 2011; Dongbing Wang.
U.S. Appl. No. 13/312,531; filed Dec. 6, 2011; Steven Liddiard.

* cited by examiner

VARIABLE RADIUS TAPER X-RAY WINDOW SUPPORT STRUCTURE

CLAIM OF PRIORITY

Priority is claimed to U.S. Provisional Patent Application Ser. No. 61/689,458, filed on Jun. 6, 2012; which is hereby incorporated herein by reference in its entirety.

This is a continuation-in-part of U.S. patent application Ser. No. 13/667,273, filed on Nov. 2, 2012, which is a continuation-in-part of U.S. patent application Ser. No. 13/453,066, filed on Apr. 23, 2012, now U.S. Pat. No. 8,989,354, which claims priority to U.S. Provisional Patent Application No. 61/486,547 filed on May 16, 2011, 61/495,616 filed on Jun. 10, 2011, and 61/511,793 filed on Jul. 26, 2011; all of which are hereby incorporated herein by reference in their entirety.

FIELD OF THE INVENTION

The present application is related generally to x-ray window support structures.

BACKGROUND

It is important for support members in support structures, such as x-ray window support structures, to be strong but also small in size. X-ray windows can include a thin film supported by the support structure, typically comprised of ribs supported by a frame. The support structure can be used to minimize sagging or breaking of the thin film. The support structure can interfere with the passage of x-rays and thus it can be desirable for ribs to be as thin or narrow as possible while still maintaining sufficient strength to support the thin film. The support structure and film are normally expected to be strong enough to withstand a differential pressure of around 1 atmosphere without sagging or breaking.

Such support structures can comprise a support frame defining a perimeter and an aperture, a plurality of ribs extending across the aperture of the support frame and carried by the support frame, and openings between the ribs. Stresses can occur at the junction of the ribs and the support frame. It can be important to reduce such stresses in order to avoid failure at this junction.

SUMMARY

It has been recognized that it would be advantageous to have a strong x-ray window support structure, and advantageous to minimize stresses at a junction of the ribs to the support frame. The present invention is directed to an x-ray window support structure that satisfies these needs. The support structure comprises a support frame defining a perimeter and an aperture, a plurality of ribs extending across the aperture of the support frame and carried by the support frame, and openings between the plurality of ribs. A rib taper region can extend from a central portion of the ribs to the support frame. The taper region can include a non-circular, arcuate pair of fillets on opposing sides of the ribs and an increasing of rib width from the central portion to the support frame.

DEFINITIONS

As used herein, the term "carbon fiber" or "carbon fibers" means solid, substantially cylindrically shaped structures having a mass fraction of at least 85% carbon, a length of at least 5 micrometers and a diameter of at least 1 micrometer.

As used herein, the term "directionally aligned," in referring to alignment of carbon fibers with ribs, means that the carbon fibers are substantially aligned with a longitudinal axis of the ribs and does not require the carbon fibers to be exactly aligned with a longitudinal axis of the ribs.

As used herein, the term "rib" means a support member and can extend, linearly or with bends or curves, by itself or coupled with other ribs, across an aperture of a support frame.

DETAILED DESCRIPTION

Figure 1:
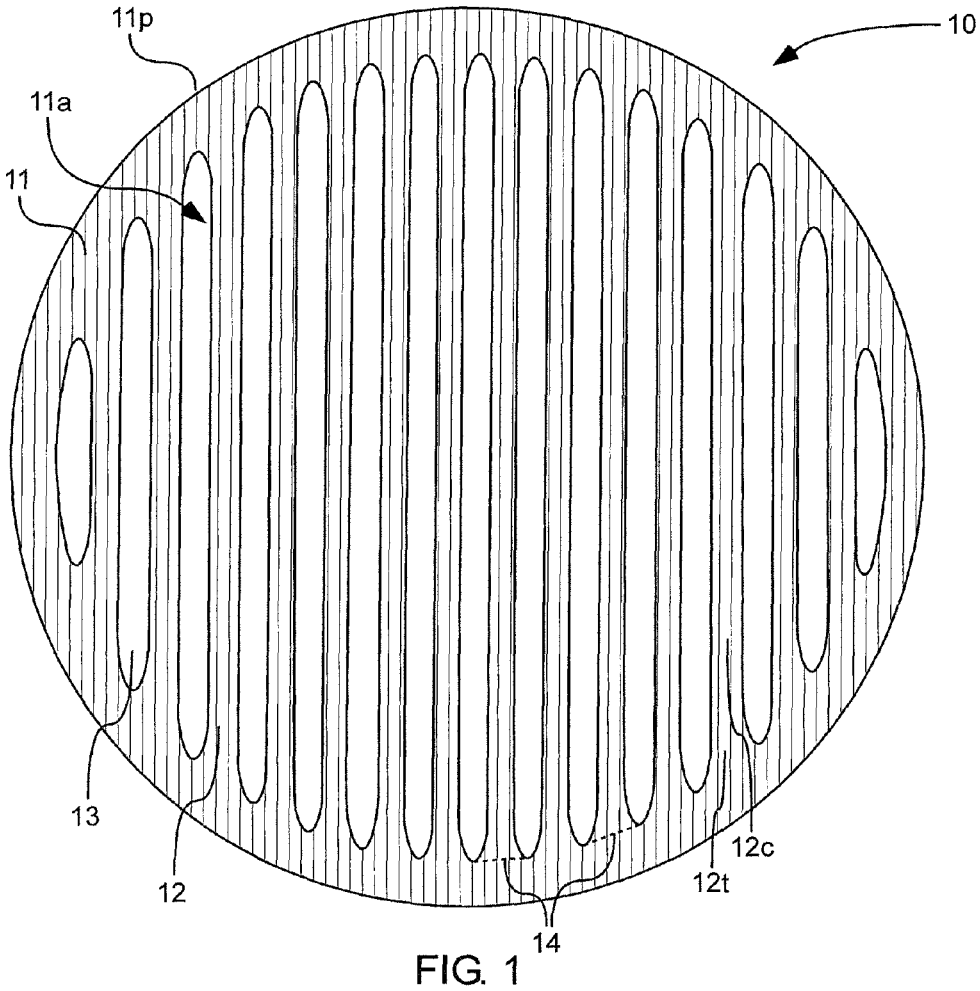
FIG. 1 is a schematic top view of an x-ray window support structure, in accordance with an embodiment of the present invention.

As illustrated in FIG. 1, a support structure 10 for an x-ray window is shown comprising a support frame 11 defining a perimeter 11*p* and an aperture 11*a*, a plurality of ribs 12 extending across the aperture 11*a* of the support frame 11 and carried by the support frame 11, and openings 13 between the plurality of ribs 12. The ribs 12 can be attached or joined to the support frame 11 at a junction 14. Typically, the ribs 12 and support frame 11 are formed integrally from a single wafer or sheet of material, but they can be formed separately and attached together, such as with an adhesive.

Figure 2:
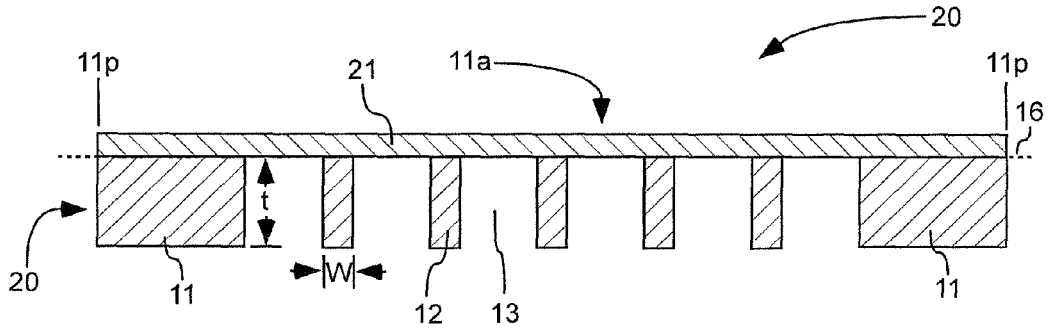
FIG. 2 is a schematic cross-sectional side view of an x-ray window, in accordance with an embodiment of the present invention.

Shown in FIG. 2 is an x-ray window 20 having tops of the ribs 12 terminating substantially in a common plane 16. A thin film 21 can be disposed over and can be attached to the ribs 12 and the support frame 11.

When the thickness t of the ribs 12 is sufficiently thin, stress on the rib material can become very large near the junction 14 of the ribs 12 with the support frame 11. A rib taper region 12*t* (shown in FIG. 1) may be used to reduce stress at this junction 14.

Figure 3:
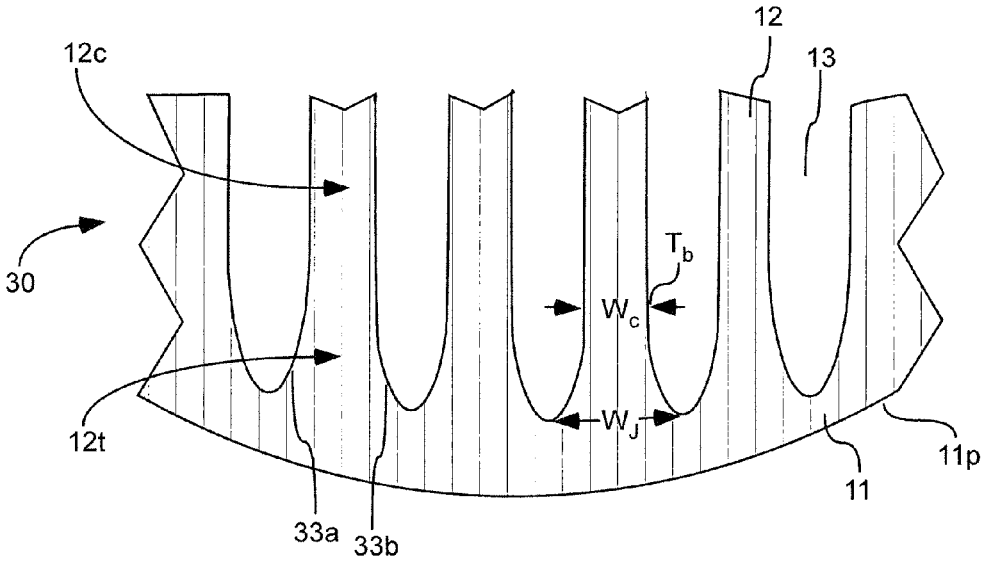
FIG. 3 is a schematic top view of a portion of an x-ray window support structure, in accordance with an embodiment of the present invention.

Shown in FIG. 3 is a section of a support structure 30. A rib taper region 12*t* can extend from a central portion 12*c* of the ribs 12 to the support frame 11. The rib taper region 12*t* can include a non-circular, arcuate pair of fillets 33*a*- and 33*b* on opposing sides of the ribs 12. Non-circular, arcuate fillets 33*a* and 33*b* can allow for reduced stress, while also allowing ribs 12 to be spaced closer together. The rib taper region 12*t* can include an increasing of rib width W from the central portion 12*c* to the support frame 11 ($W_f > W_c$). Rib width W can continuously and smoothly increase, with no sharp angles or inflection points, from the central portion 12*c* to the support frame 11.

The support structures 30 and 40 described herein may be further defined or quantified by the shape of the ribs 12, such as having a long length relative to an increase in rib width W in the rib taper region 12*t*. The support structures 30 and 40 described herein may also be defined or quantified by the shape of the openings 13 in the rib taper region 12*t*, such as a relationship of rib length in the rib taper region 12*t* to an opening width, a relationship of radius of curvature at a taper beginning to a radius of curvature at the support frame 11, or elliptical shaped openings 13. These definitions can be used to quantify the non-circular, arcuate shape of the fillets 33*a*- and 33*b* of the rib taper region 12*t*.

Figure 4:
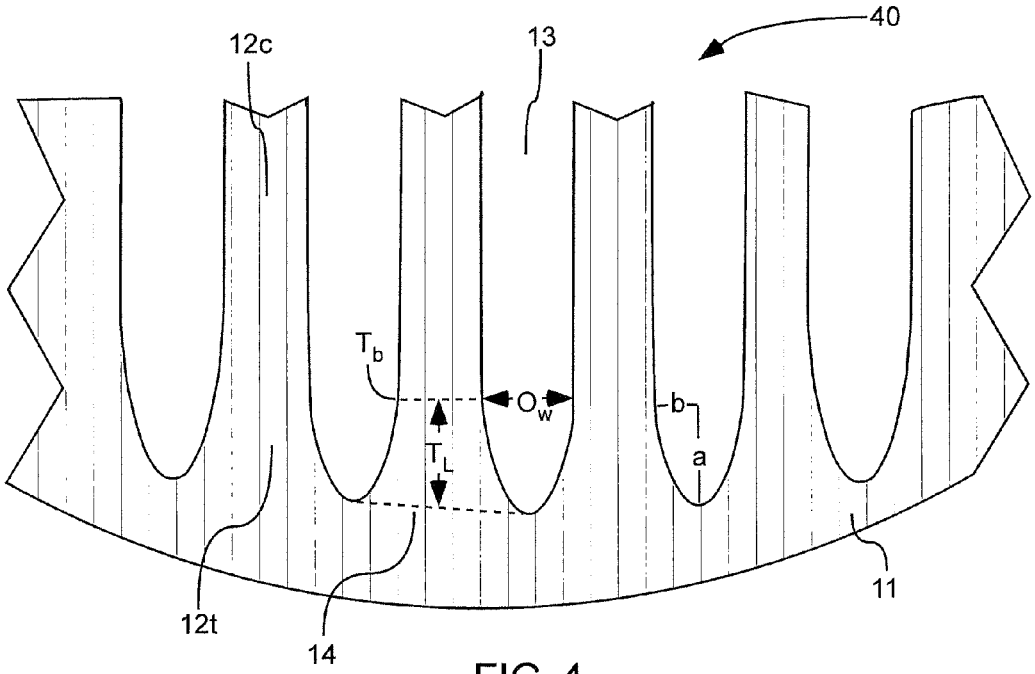
FIG. 4 is a schematic top view of a portion of an x-ray window support structure, in accordance with an embodiment of the present invention.

As shown on support structures 30 and 40 in FIGS. 3-4, a location where the central portion 12*c* of the ribs 12 meets the rib taper region 12*t* defines a taper beginning $T_b$; a rib width at the taper beginning $T_b$ defines a central rib width $W_c$; a rib width at a junction 14 of the rib 12 with the support frame 11 defines a junction rib width $W_J$; and a straight line distance, parallel with a center of the rib 12, from the taper beginning $T_b$ to the support frame 11 defines a taper length $T_L$. In one aspect, the central rib width $W_c$, the junction rib width $W_J$, and the taper length $T_L$ can satisfy the equation:

$$1 < \frac{T_L}{W_J - W_c} < 3.$$

In another aspect, the central rib width $W_c$, the junction rib width $W_J$, and the taper length $T_L$ can satisfy the equation:

$$1.4 < \frac{T_L}{W_J - W_c} < 2.2.$$

These equations can quantify a long length of the ribs 12 relative to an increase in rib width W in the rib taper region 12*t*.

As shown on support structure 40 of FIG. 4, an opening 13 width at the taper beginning $T_b$ defines a taper opening width $O_w$. The taper length $T_L$ divided by the taper opening width $O_w$ can be between 1 and 3

$$\left(1 < \frac{T_L}{O_w} < 3\right)$$

in one aspect, or between 1.4 and 2.2

$$\left(1.4 < \frac{T_L}{O_w} < 2.2\right)$$

in another aspect. These equations can quantify a long length of the ribs 12 in the rib taper region 12*t* relative to an opening width $O_w$ at the taper beginning $T_b$.

Figure 5:
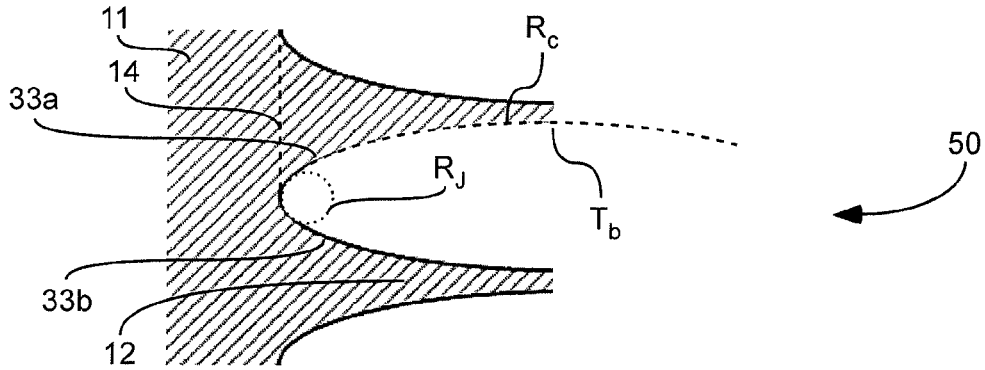
FIG. 5 is a schematic top view of a portion of an x-ray window support structure, in accordance with an embodiment of the present invention.

As shown on support structure 50 of FIG. 5, a radius of curvature of the fillets 33*a* and 33*b* at the taper beginning $T_b$ defines a central radius $R_c$ and a radius of curvature of the fillets 33*a* and 33*b* at a junction 14 of the ribs 12 with the support frame 11 defines a junction radius $R_J$. The central radius $R_c$ divided by the junction radius $R_J$ can be between 10 and 100

$$\left(10 < \frac{R_c}{R_J} < 100\right)$$

in one aspect. The central radius $R_c$ divided by the junction radius $R_J$ can be between 20 and 50

$$\left(20 < \frac{R_c}{R_J} < 50\right)$$

in another aspect. These equations can quantify a large radius of curvature at the taper beginning $T_b$ relative to a substantially smaller radius of curvature at a junction 14 of the ribs 12 with the support frame 11, thus quantifying the non-circular, arcuate shape of the ribs 12.

The larger radius of curvature closer to the central portion 12*c* of the ribs 12 can result in reduced stress in the ribs 12, and thus greater rib strength and reduced risk of rib failure. The gradually and continually decreasing radius of curvature towards the junction 14 can allow ribs 12 to be packed closer together. Thus, if a larger spacing between ribs 12 is allowed, such as if a relatively strong film 21 is used, then the central radius $R_c$ divided by the junction radius $R_J$ can be relatively smaller. If a smaller spacing between ribs 12 is allowed, such as if a thinner or relatively weaker film 21 is used, then the central radius $R_c$ divided by the junction radius $R_J$ may need to be larger.

Figure 6:
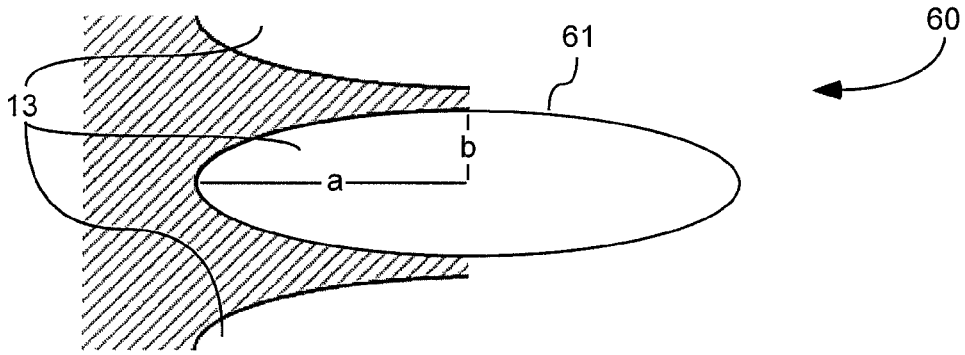
FIG. 6 is a schematic top view of a portion of an x-ray window support structure, in accordance with an embodiment of the present invention.

As shown on support structure 60 of FIG. 6, openings 13 can have a half-elliptical shape 61 between ribs 12 in the rib taper region 12*t*. Eccentricity e of the half-elliptical shape 61 can be between 0.90 and 0.99 (0.90<e<0.99) in one aspect, between 0.80 and 0.99 (0.80<e<0.99) in another aspect, between 0.93 and 0.98 (0.93<e<0.98) in another aspect, or between 0.75 and 0.90 (0.75<e<0.90) in another aspect. Eccentricity e is defined as:

$$= \sqrt{1 - \frac{b^2}{a^2}}.$$

These equations can quantify the shape of openings 13 in the rib taper region 12*t*.

Figure 7:
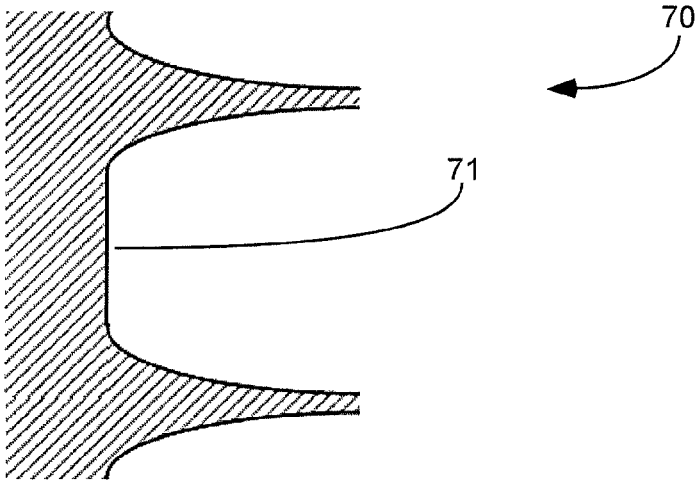
FIG. 7 is a schematic top view of a portion of an x-ray window support structure, in accordance with an embodiment of the present invention.

In previous figures, ribs 12 were shown packed closely together, such that where the rib taper for one rib 12 ended at the support structure 11, a rib taper for another rib 12 began. As shown on support structure 70 of FIG. 7, ribs 12 can be spaced farther apart, such that there is a region of an inner perimeter 71 of the support structure 70 in which there are no ribs 12, and no beginning of taper of ribs 12.

The central portion 12*c* of the ribs 12 can have a substantially constant width W, and ribs 12 can be substantially parallel with each other, as is shown on support structure 10 in FIG. 1. A variable rib width W in the central portion 12*c*, or non-parallel ribs, such as hexagonal or intersecting ribs, are also within the scope of this invention.

The ribs 12 and/or the support frame 11 can comprise low atomic number elements such as aluminum, beryllium, boron, carbon, fluorine, hydrogen, nitrogen, oxygen, and/or silicon. Use of such low atomic number elements can result in minimized x-ray spectrum contamination. The ribs 12 and/or the support frame 11 can comprise boron carbide, boron hydride, boron nitride, carbon fiber composite, carbon nanotube composite, kevlar, mylar, polyimide, polymer, silicon nitride, diamond, diamond-like carbon, graphitic carbon, pyrolytic graphite, and/or amorphous carbon. The openings 13, ribs 12, and support frame 11 can be formed by laser ablation. Manufacturing of the support structure from a carbon composite wafer is described in U.S. patent application Ser. No. 13/667,273, filed on Nov. 2, 2012, and in U.S. patent application Ser. No. 13/453,066, filed on Apr. 23, 2012, which are hereby incorporated herein by reference. If a carbon composite support structure is used, carbon fibers in the carbon composite can be directionally aligned with the ribs 12.

The film 21, described previously in the description of FIG. 2, can be configured to pass radiation therethrough. For example, the film 21 can be made of a material that has a low atomic number and can be thin, such as for example about 5 to 500 micrometers (μm). The film 21 can have sufficient strength to allow differential pressure of at least one atmosphere without breaking. The film 21 can be hermetic or air-tight. The film 21 can combine with one of the support structures described herein and a shell to form a hermetic enclosure.

The invention claimed is:

1. A support structure for an x-ray window, the support structure comprising:

a) a support frame defining a perimeter and an aperture;

b) a plurality of ribs extending across the aperture of the support frame and carried by the support frame;

c) the support frame and the plurality of ribs comprising a carbon composite material including carbon fibers embedded in a matrix;

d) the plurality of ribs forming openings between the plurality of ribs;

e) a rib taper region extending from a central portion of each of the plurality of ribs to the support frame;

f) the rib taper region including a non-circular, arcuate pair of fillets on opposing sides of each of the plurality of ribs; and g) the rib taper region including an increasing of rib width from the central portion to the support frame.

2. The support structure of claim 1, wherein:

a) a location where the central portion of each of the plurality of ribs meets the rib taper region defines a taper beginning;

b) a radius of curvature of the pair of fillets at the taper beginning defines a central radius;

c) a radius of curvature of the pair of fillets at a junction of each of the plurality of ribs with the support frame defines a junction radius; and d) the central radius divided by the junction radius is between 10 and 100.

3. The support structure of claim 1, wherein openings at the rib taper region have a half-elliptical shape.

4. The support structure of claim 3, wherein the half-elliptical shape has an eccentricity of between 0.90 and 0.99.

5. The support structure of claim 3, wherein the half-elliptical shape has an eccentricity of between 0.80 and 0.99.

6. The support structure of claim 1, wherein:

a) a location where the central portion of each of the plurality of ribs meets the rib taper region defines a taper beginning;

b) a straight line distance, parallel with a center of each of the plurality of ribs, from the taper beginning to the support frame defines a taper length;

c) an opening width at the taper beginning defines a taper opening width; and d) the taper length divided by the taper opening width is between 1 and 3.

7. The support structure of claim 6, wherein the taper length divided by the taper opening width is between 1.4 and 2.2.

8. The support structure of claim 1, wherein:

a) a location where the central portion of each of the plurality of ribs meets the rib taper region defines a taper beginning;

b) a rib width at the taper beginning defines a central rib width;

c) a rib width at a junction of each of the plurality of ribs with the support frame defines a junction rib width;

d) a straight line distance, parallel with a center of each of the plurality of ribs, from the taper beginning to the support frame defines a taper length; and e) the central rib width, the junction rib width, and the taper length satisfy the equation:

$$1 < \frac{\text{taper length}}{\text{junction rib width} - \text{central rib width}} < 3.$$

9. The support structure of claim 8, wherein the central rib width, the junction rib width, and the taper length satisfy the equation:

$$1.4 < \frac{\text{taper length}}{\text{junction rib width} - \text{central rib width}} < 2.2.$$

10. The support structure of claim 1, wherein tops of the plurality of ribs terminate substantially in a common plane, and further comprising a film disposed over, carried by, and spanning the plurality of ribs and disposed over and spanning the openings, and configured to pass radiation therethrough.

11. The support structure of claim 1, wherein the openings, the plurality of ribs, and the support frame were formed by laser ablation of a carbon composite wafer, and carbon fibers in the carbon composite are substantially aligned with the plurality of ribs.

12. The support structure of claim 1, wherein the central portion of each of the plurality of ribs has a substantially constant width.

13. A support structure for an x-ray window, the support structure comprising:

a) a support frame defining a perimeter and an aperture;

b) a plurality of ribs extending across the aperture of the support frame and carried by the support frame;

c) the plurality of ribs forming openings between the plurality of ribs;

d) a rib taper region extending from a central portion of each of the plurality of ribs to the support frame;

e) the rib taper region including a non-circular, arcuate pair of fillets on opposing sides of each of the plurality of ribs;

f) the pair of fillets include a larger radius of curvature closer to the central portion of the ribs and a smaller radius of curvature towards the support frame; and g) the rib taper region including an increasing of rib width from the central portion to the support frame.

14. The support structure of claim 13, wherein the plurality of ribs comprise carbon, carbon fiber composite, silicon, boron carbide, or combinations thereof.

15. The support structure of claim 13, wherein:

a) the support frame and the plurality of ribs comprise a carbon composite material including carbon fibers embedded in a matrix; and b) the openings, the plurality of ribs, and the support frame were integrally formed by laser ablation of a carbon composite wafer.

16. The support structure of claim 13, wherein:

a) a location where the central portion of each of the plurality of ribs meets the rib taper region defines a taper beginning;

b) a radius of curvature of the pair of fillets at the taper beginning defines a central radius;

c) a radius of curvature of the pair of fillets at a junction of each of the plurality of ribs with the support frame defines a junction radius; and d) the central radius divided by the junction radius is between 10 and 100.

17. The support structure of claim 13, wherein openings at the rib taper region have a half-elliptical shape having an eccentricity of between 0.80 and 0.99.

18. The support structure of claim 13, wherein:

a) a location where the central portion of each of the plurality of ribs meets the rib taper region defines a taper beginning;

b) a rib width at the taper beginning defines a central rib width;

c) a rib width at a junction of each of the plurality of ribs with the support frame defines a junction rib width;

d) a straight line distance, parallel with a center of each of the plurality of ribs, from the taper beginning to the support frame defines a taper length; and e) the central rib width, the junction rib width, and the taper length satisfy the equation:

$$1 < \frac{\text{taper length}}{\text{junction rib width} - \text{central rib width}} < 3.$$

19. A support structure for an x-ray window, the support structure comprising:

a) a support frame defining a perimeter and an aperture;

b) a plurality of ribs extending across the aperture of the support frame and carried by the support frame;

c) tops of the plurality of ribs terminate in a common plane;

d) the plurality of ribs forming openings between the plurality of ribs;

e) a rib taper region extending from a central portion of each of the plurality of ribs to the support frame;

f) the rib taper region including a non-circular, arcuate pair of fillets on opposing sides of each of the plurality of ribs;

g) the rib taper region including an increasing of rib width from the central portion to the support frame;

h) the openings at the rib taper region have a half-elliptical shape having an eccentricity of between 0.80 and 0.99; and i) the plurality of ribs comprise carbon, carbon fiber composite, silicon, boron carbide, or combinations thereof.

20. The support structure of claim 19, wherein the openings and the plurality of ribs were formed by laser ablation.

* * * * *